US005638898A

United States Patent [19]

Gu

[11] Patent Number: 5,638,898

[45] Date of Patent: Jun. 17, 1997

[54] SHELL-AND-TUBE HEAT EXCHANGER WITH CORRUGATED HEAT TRANSFER TUBES

[76] Inventor: Guang-rui Gu, No. 59-6, Dong Zhan Street, Lianhe Rd., Shenyang, China, 110044

[21] Appl. No.: 566,501

[22] Filed: Dec. 4, 1995

[30] Foreign Application Priority Data

Dec. 8, 1994 [CN] China ..... CN 94231468.9

[51] Int. Cl.[6] ..... F28D 7/10

[52] U.S. Cl. ..... 165/160; 165/177; 165/DIG. 406; 165/DIG. 532

[58] Field of Search ..... 165/159, 160, 165/177, 179, DIG. 406

[56] References Cited

U.S. PATENT DOCUMENTS

| | | | |
|---|---|---|---|
| 63,077 | 3/1867 | Montgomery | 165/177 |
| 1,913,573 | 6/1933 | Turner | 165/177 X |
| 3,612,175 | 10/1971 | Ford et al. | 165/179 |
| 4,305,460 | 12/1981 | Yampolsky | 165/179 |
| 4,685,292 | 8/1987 | Brigham et al. | 60/320 |

FOREIGN PATENT DOCUMENTS

| | | | |
|---|---|---|---|
| 505127 | 5/1939 | United Kingdom | 165/160 |

*Primary Examiner*—Allen J. Flanigan

*Attorney, Agent, or Firm*—Merchant, Gould, Smith, Edell, Welter & Schmidt, P.A.

[57] ABSTRACT

A shell-and-tube heat exchanger includes a shell, heat transfer tubes, tube plates, covers, inlet and outlet for fluid flowing into and out of the shell, and inlet and outlet for fluid flowing into and out of the tubes, wherein the heat transfer tubes are corrugated heat transfer tubes, the tubing wall of the corrugated heat transfer tube is configured along the longitudinal direction of the corrugated heat transfer tube in a shape formed by tangentially connecting the crests of large arcs and the valleys of small arcs, the outside diameter D of the corrugated heat transfer tube is set at 1.3 to 1.5 times the inside diameter d, the corrugated heat transfer tubes are arranged spirally around the axis of the shell in multi-layers, and spiral plates are inserted between two layers of the corrugated heat transfer tubes.

4 Claims, 2 Drawing Sheets

SHELL-AND-TUBE HEAT EXCHANGER WITH CORRUGATED HEAT TRANSFER TUBES

FIELD OF THE INVENTION

The present invention relates generally to heat exchangers, and more particularly, to a shell-and-tube heat exchanger with corrugated heat transfer tubes.

BACKGROUND OF THE INVENTION

A conventional shell-and-tube heat exchanger is mainly comprised of a shell and heat transfer tubes within it. For the improvement of heat transfer efficiency, baffles are provided in the shell to increase the distance of fluid flow in the shell. In the shell-and-tube heat exchangers of the above structure, however, the clearance between the heat transfer tubes and the through holes of the baffles are relatively large, so the fluid will flow through the clearance directly and the effect of the baffles will decrease. More seriously, impact is likely to occur between the heat transfer tubes and the baffles resulting in breakage of the heat transfer tubes.

In addition, most shell-and-tube heat exchangers use straight heat transfer tubes, with wall thickness generally exceeding 10% of the inside diameter of the tube. Heat exchangers of such a construction have drawbacks of small heat transfer coefficients, being subject to corrosion, scaling readily, occupying large space, and requiring large amount of materials. Although many attempts have been made to improve sell-and-tube hear exchangers, the results are not substantial, with the heat transfer coefficient remaining around 1000 kcal/m$^2$·h·°C. (water-water heat exchange).

U.S. Pat. No. 4,305,460 disclosed a spirally fluted metallic heat transfer tube, wherein the finished tube has the provision of a predetermined number range of multiple start continuous helical flutes formed along its longitudinal length. The helical angle of the flutes induces rotation of the flow within the flutes and of the bulk flow as a result of the curvature of the flutes. The core flow is primarily in solid body rotation, has no strain, and is stable. In the region between the core flow and the flute flow, there is an interchange of angular momentum from the individual flutes to the core flow, resulting in a decrease of the angular momentum in the flutes. This is the case of instability, since the decrease of the peripheral velocity is destabilizing. The instability increases with radially inward heat flow through the wall and decreases with the direction of heat flow outward. Instability enhances the turbulent exchange near the wall, leading to improved heat transfer since most of the resistance to heat flow is in the laminar sublayer.

The heat transfer tube described in the above U.S. Pat. No. 4,305,460, however, lacks flexibility in its longitudinal direction, resulting in being reluctant to undergo elastic deformation in the longitudinal direction, which is not favorable for the heat transfer tube to prevent scaling and to be cleaned of scales. Moreover, in the flow of fluids within the tube there occurs no back-flow essentially and thus no substantial turbulent flow. In addition, because the fluted metallic strips are formed into such heat transfer tubes through opposed contour rollers or by extrusion means, the stress state in the strips is not favorable with many intercrystalline defects readily subject to stress corrosion.

SUMMARY OF THE INVENTION

One of the objects of the present invention is to provide a shell-and-tube heat exchanger with corrugated heat transfer tubes, which has higher heat transfer efficiency and reliability.

Another object of the present invention is to provide a corrugated heat transfer tube capable of self-scale cleaning, which permits lessening scale cleaning work and decreasing the adverse effect of the thermal resistance of scales on the heat transfer efficiency of the tube.

An additional object of the present invention is to provide an anticorrosive corrugated heat transfer tube which gives a prolonged life of heat exchanger.

A further object of the present invention is to provide a corrugated heat transfer tube having effectively increased heat transfer area and thus further enhancing the heat transfer effect of the tube.

According to one aspect of the present invention, a shell-and-tube heat exchanger comprise a shell, heat transfer tubes, tube plates, covers, inlet and outlet for fluid flowing into and out of the shell, and inlet and outlet for fluid flowing into and out of the tubes, wherein the said heat transfer tubes are corrugated heat transfer tubes, the tubing wall of the said corrugated heat transfer tube is configured along the longitudinal direction of the said corrugated heat transfer tube in a shape formed by tangentially connecting the crests of large arcs and the valleys of small arcs, the outside diameter D of the said corrugated heat transfer tube is set at 1.3 to 1.5 times the inside diameter d, the said corrugated heat transfer tubes are arranged spirally around the axis of the shell in multilayers, and spiral plates are inserted between two layers of the said corrugated heat transfer tubes.

According to another aspect of the present invention, the wall thickness of the said corrugated heat transfer tube is set less than 2% of the inside diameter of said corrugated heat transfer tube.

According to one more aspect of the present invention, the ratio of the radius of the crest to that of the valley of the said corrugated heat transfer tube is set at 3 to 5.

According to a further aspect of the present invention, the diameter of at least one entrance of the said corrugated heat transfer tube is made equal to the outside diameter of the said corrugated heat transfer tube.

According to one more aspect of the present invention, the said corrugated heat transfer tube is made of stainless steels or copper alloys.

BRIEF DESCRIPTION OF THE DRAWINGS

The various objects and advantages of the present invention will become apparent from the following detailed description of the invention when taken in conjunction with the accompanying drawing.

DETAILED DESCRIPTION OF THE PREFERRED EMBODIMENTS

Figure 1:
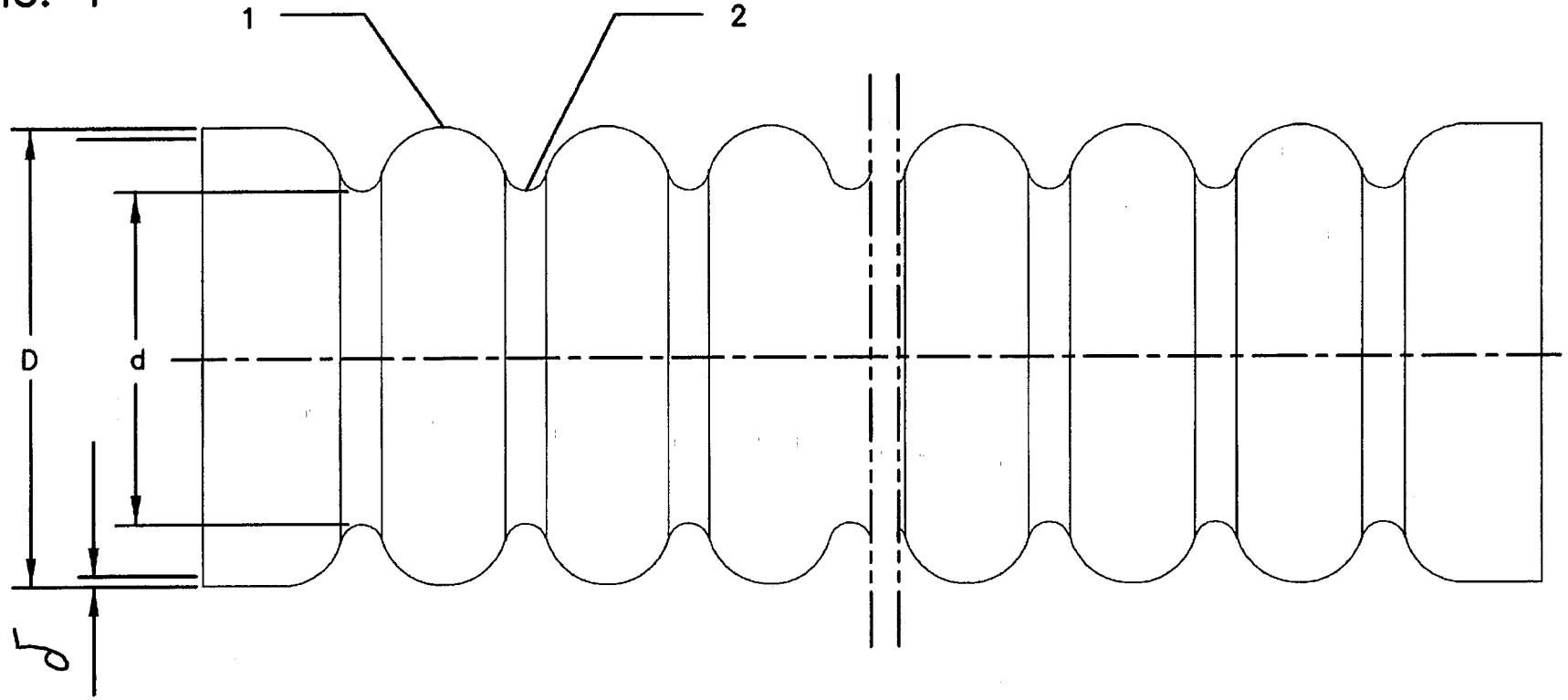
FIG. 1 is a schematic view of the tubing construction of a corrugated heat transfer tube according to the present invention.

Referring to FIG. 1, the corrugated heat transfer tube of the present invention uses a corrugated construction formed by tangentially connecting the crests of large arcs 1 and the valleys of small arcs 2 (hereafter referred to as a complete circular arc construction), the wall thickness δ is set less than 2% of the inside diameter d of the tubing, that is $\delta/d<2/100$, the outside diameter D and the inside diameter d of the tubing, is set at a ratio D/d=1.3–1.5, the diameter of at least one entrance of the tubing is set equal to the outside diameter of the tubing.

Every portion of the heat transfer tube of the complete circular arc construction described above according to the present invention possesses a certain flexibility, i.e., the said heat transfer tube constitutes a fully elastic system capable of contracting in both longitudinal and transverse directions. It can prevent scaling for two aspects:

Firstly, the fluid flow within this elastic complete circular arc system is in a state of full turbulence with no local laminar flow, and can flush the entire wall surface of the heat transfer tube. There is, therefore little possibility of scale deposition.

Secondly, the complete circular arc construction of the said corrugated heat transfer tube will undergo elastic deformation upon being thermally shocked, and as a result, the scales ever formed on the wall will be broken and flushed away by the turbulently flowing fluid.

Table 1 gives the design parameters of a corrugated heat transfer tube according to an embodiment of the present invention

TABLE 1

| inside diameter | outside diameter | wall thickness | distance between crests | radius of crest arc | radius of valley arc |
|---|---|---|---|---|---|
| d | D | $\delta$ | t | R | r |
| mm | mm | mm | mm | mm | mm |
| 32 | 44 | 0.5 | 25 | 10 | 2.5 |

Suppose the length of tubing of heat transfer tube is $L_0$, the maximum temperature difference is $\Delta t$, the total elastic deformation as the result of the thermal shock becomes $$\Delta=\alpha L_0 \Delta\tau \quad (1)$$

If $L_0$is 3000 mm, $\Delta t$ is 100° C., $\alpha$ is $17\times10^{-6}$/°C., then $\Delta=17\times10^{-6}\times3000\times100=5.1$ mm The elastic deformation for each crest or wave is $$\Delta_0=\Delta/(L_0/t)=5.1/(3000/25)=0.0425 \text{ mm}$$

The ratio of deformation is $$\epsilon=\Delta_0/t=0.0425/25=0.0017$$

Assuming that the elastic modulus of the salt scale is E=7000 kg/mm$^2$, the maximum stress developed in the scale is $$\sigma=7000\times0.17\%=11.9 \text{ kg/mm}^2$$

then the maximum tensile force exerted on the scale is $$F=\sigma\pi D\delta_g \quad (2)$$

Where $\delta_g$ is the scale thickness, Assuming $\delta_g$ is 0.1 mm, then $$F=11.9\times3.14\times44\times0.1=164.41 \text{ kg}$$

This means that, upon thermal shock, there is a tensile force of 164.41 kg within the scale of 0.1 mm thickness and the corresponding deformation occurs. If the adhesion strength between the scale and the tube wall is smaller than 164.41 kg, the scale will come off the wall surface. If the adhesion strength $F_g$ is known, then the scale thickness at which the scale comes off the wall surface can be determined:

$$\delta_g=F_g/\pi DE\alpha\Delta t \quad (3)$$

From the above crude analysis it can be concluded that the deformation taking place in corrugated heat transfer tube as a result of the thermal shock can lead to the separation of the scale from the heat transfer tube wall. In addition, the corrugated heat transfer tube according to the present invention uses a complete circular arc construction formed by tangentially connecting the crests of large arcs and the valleys of small arcs, where the ratio of the radius of the crest arc to that of the valley arc is set at 3 to 5, leading to back flow and thus further realizing full turbulence in both flows inside and outside the heat transfer tube.

The wall thickness $\delta$ of the heat transfer tube of the present invention is made less than 2% of the inside diameter of the tubing, which is mainly in consideration of achieving optimum heat transfer coefficient. The overall heat transfer coefficient across the heat transfer tube is $$k=1/[(1/\alpha_i+\gamma_i)+\delta/\lambda+(1/\alpha_0+\gamma_0)] \quad (4)$$

where $\alpha_i$ is the heat transfer coefficient inside the tube, $\alpha_0$ is the heat transfer coefficient outside the tube, $\gamma_i$ is the thermal resistance of the scale on the inside tube surface (m$^2$·h·°C./kcal), $\gamma_0$ is the thermal resistance of the scale on the outside tube surface (m$^2$·h·°C./kcal), $\delta$ is the wall thickness of the heat transfer tube, $\lambda$ is the thermal conductivity of the heat transfer tube material. In the following, a set of thick-walled and thin-walled stainless steel corrugated tubes are compared for their overall heat transfer coefficients, with the thermal resistance of scales both inside and outside the tube neglected for convenience of analysis.

Assuming that the thermal conductivity of the stainless steel of which the corrugated tube is made $\lambda$=20 kcal/m$^2$·h·°C., heat transfer coefficient inside the tube $\alpha_i$=8000 kcal/m$^2$·h·°C. and heat transfer coefficient outside the tube $\alpha_0$=4000 kcal/m$^2$·h·°C.

For a thick-walled stainless steel corrugated tube with wall thickness $\delta$=2.5 mm, $$k=1/[1/8000+1/4000+0.0025/20]=1/0.0005=2000 \text{ kcal/m}^2\cdot\text{h}\cdot°\text{C}.$$

For a thin-walled stainless steel corrugated tube with wall thickness $\delta$=0.5 mm, $$k=1/[1/8000+1/4000+0.0005/20]=1/0.0004=2500 \text{ kcal/m}^2\cdot\text{h}\cdot°\text{C}.$$

The two values differ by 25%, and the difference increases with the increase in the intensity of heat transfer. For example, when $\alpha_i$=20000 kcal/m$^2$·h·°C., $\alpha_0$=6000 kcal/m$^2$·h·°C.

for the thick-walled stainless steel corrugated tube $$k=1/[1/20000+1/6000+0.0025/20]=1/0.000342=2924 \text{ kcal/m}^2\cdot\text{h}\cdot°\text{C}.$$

for the thin-walled stainless steel corrugated tube $$k=1/[1/20000+1/6000+0.0005/20]=1/0.000242=4132 \text{ kcal/m}^2\cdot\text{h}\cdot°\text{C}.$$

The two values differ by 41%. It is shown from above that the wall thickness of the heat transfer tube has a direct effect on the heat transfer coefficient. For thin-walled heat transfer tubes, the effect of intensification of heat transfer on the value of the overall heat transfer coefficient is larger than the case of thick-walled heat transfer tubes and the effect of intensification of heat transfer is a dominant factor.

If the thermal resistance of scale, neglected for convenience in the above analysis, is to be taken into account, then for thin-walled stainless steel corrugated tubes, the thermal resistance of scale is actually negligible because of the said scale self-preventing and self-cleaning capacity of the complete circular arc construction. For thick-walled corrugated tubes, the thermal resistance of scale must be taken into account, resulting in an increased difference between the heat transfer coefficients.

In the present invention, the use of a thin-walled construction with wall thickness δ less than 2% of the inside diameter d of the tubing permits a substantial decrease in the expense of the heat transfer tube material. This makes it possible to use costly anti-corrosion materials, such as stainless steels, copper alloys and the like, and this in turn increases the life of the heat transfer tube.

The problem of stress corrosion becomes, of course, particularly important, when metallic materials of relatively low wall thickness are used to fabricate heat transfer tubes. However, a "free forming" or "soft forming" method is used for heat transfer tube fabrication, wherein the forming of metal is achieved by a free or soft deformation process, not by a forced flow of metal in a mold. In such a forming method without forced forming of material, excessive stress concentration is impossible, the distribution of stress is uniform, residual stresses are small, and there are no intercrystalline defects. These effectively give a solution to the stress corrosion problem. Stress corrosion is actually and radically avoided, of course, by the use of a complete circular arc construction in the present invention.

In addition, it can be seen from FIG. 1 that the use of corrugated heat transfer tubes of a complete circular arc construction of the present invention will give a larger heat transfer area as compared with a straight heat transfer tube with smooth wall surface or a spirally fluted heat transfer tube if the diameters of the tubes are the same.

Figure 2:
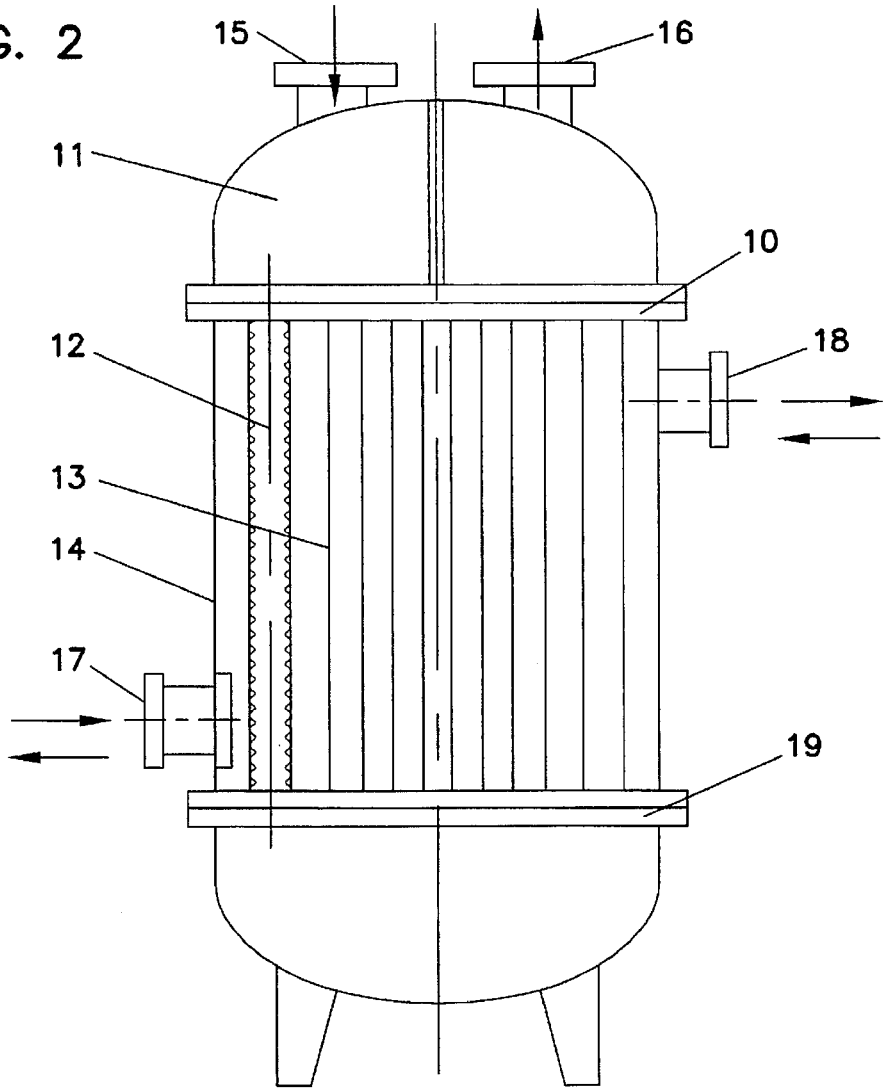
FIG. 2 is a schematic view showing the overall structure of the shell-and-tube heat exchanger with corrugated heat transfer tubes.
Figure 3:
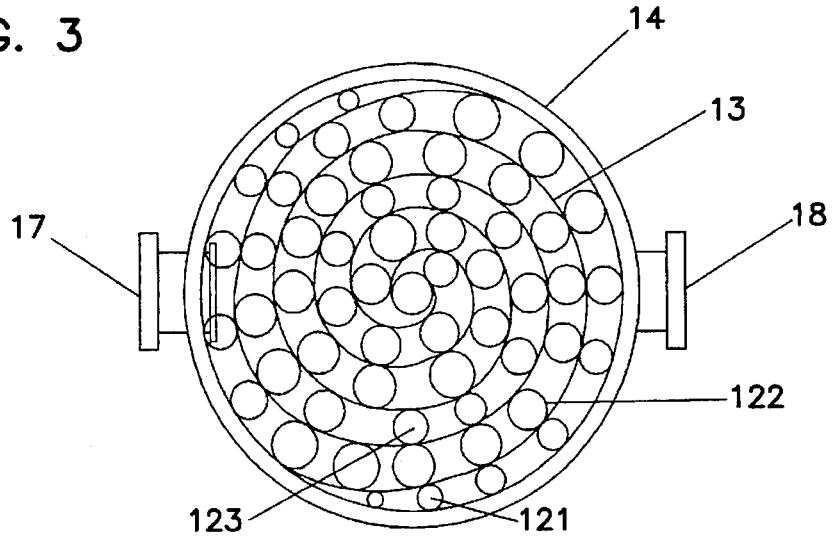
FIG. 3 is a sectional drawing of the shell-and-tube heat exchanger shown in FIG. 2, which shows the arrangement of the corrugated heat transfer tubes and the spiral plates.

Referring to FIG. 2 and FIG. 3, the shell-and-tube heat exchanger of the present invention comprises shell 14, tube plate 10 and 19, cover 11, corrugated heat transfer tubes 12 and spiral plates 13 installed in the shell 14, inlet 17 and outlet 18 for fluid in shell 14, and inlet 15 and outlet 16 for fluid in tubes 12. Wherein the corrugated heat transfer tubes are arranged spirally around the axis of the shell 14 in multi-layers 121, 122, 123, and so on, spiral plates 13 are inserted between two layers of the corrugated heat transfer tubes 12. One end of the spiral plate 13 is for example, fixed on tube plates 10 and 19, the other end of the spiral plate 13 is, for example, fixed on the inside surface of the shell 14. Thus, on the one hand, all layers of the corrugated heat transfer tubes 12 are separated from each other by spiral plates 13, eliminating the possibility of short pass between the fluid in different layers and increasing the efficiency of heat transfer of the heat exchanger; on the other hand, the heat transfer tubes 12 are sandwiched between the spiral plates 13, eliminating the possibility of impact between the heat transfer tubes 12 and the spiral plates 13 and improving the reliability of the heat exchanger. At the same time, the stream of the fluid in the shell becomes complicated and the turbulence of the fluid flow in shell is greatly increased, because the fluid in shell flows between the spiral plate 13 and the valleys 2 on the corrugated heat transfer tube surface. Therefore, the present invention has solved the problem of conventional shell-and-tube heat exchangers that the turbulence of the fluid flow in the shell is not full and the efficiency of the heat transfer is not high.

What is claimed is:

1. A shell-and-tube heat exchanger, comprising:

a shell having a longitudinal axis;

a plurality of tube plates disposed proximate two ends of the shell;

a cover covering the shell;

a plurality of corrugated heat transfer tubes and spiral plates installed in the shell;

first inlet and first outlet for fluid flowing into and out of the shell;

second inlet and second outlet for fluid flowing into and out of the corrugated heat transfer tubes;

a tubing wall of each of the corrugated heat transfer tubes being configured along a longitudinal direction of the corrugated heat transfer tube in a shape formed by tangentially connecting crests of larger arcs and valleys of smaller arcs, leading to back flow and thus further full turbulence in both flows inside and outside the heat transfer tube, a thickness of the corrugated heat transfer tube is less than 2% of an inside diameter of the corrugated heat transfer tube, such that the corrugated heat transfer tube constitutes a fully elastic system capable of contracting in both the longitudinal direction and a transverse direction, an outside diameter of the corrugated heat transfer tube being 1.3 to 1.5 times the inside diameter, the corrugated heat transfer tubes being arranged spirally around the longitudinal axis of the shell in multi-layers, the corrugated heat transfer tubes being sandwiched between spiral plates, and the fluid in the shell flowing between each of the spiral plates and the valleys on a surface of the corrugated heat transfer tube.

2. A shell-and-tube heat exchanger as claimed in claim 1, wherein a ratio of a radius of the each of the arcs of the crests to a radius of the each of the arcs of the valleys is 3 to 5.

3. A shell-and-tube heat exchanger as claimed in claim 1, wherein the inside diameter of at least one entrance of the corrugated heat transfer tube is equal to the outside diameter of the corrugated heat transfer tube.

4. A shell-and-tube heat exchanger as claimed in claim 1, wherein the corrugated heat transfer tube is made of stainless or copper alloys.

* * * * *